US008469222B1

(12) United States Patent
Stavitzski et al.

(10) Patent No.: US 8,469,222 B1
(45) Date of Patent: Jun. 25, 2013

(54) HOLDER, DISPLAY, AND TRANSPORT APPARATUS FOR BAKED GOODS

(75) Inventors: David Stavitzski, Delano, MN (US); Carol Decker, Plymouth, MN (US); Elizabeth Glover, Minnetonka, MN (US)

(73) Assignee: Decopac, Inc., Anoka, MN (US)

( * ) Notice: Subject to any disclaimer, the term of this patent is extended or adjusted under 35 U.S.C. 154(b) by 0 days.

(21) Appl. No.: 13/554,770

(22) Filed: Jul. 20, 2012

Related U.S. Application Data

(63) Continuation of application No. 13/416,511, filed on Mar. 9, 2012.

(51) Int. Cl.
*B65D 1/24* (2006.01)
*B65D 1/36* (2006.01)
*B65D 85/36* (2006.01)

(52) U.S. Cl.
USPC ..... 220/507; 220/23.8; 206/563

(58) Field of Classification Search
USPC ..... 220/23.8, 23.86, 23.87, 507, 573.1, 220/573.4; 206/562, 563
See application file for complete search history.

(56) References Cited

U.S. PATENT DOCUMENTS

D369,508 S * 5/1996 Jones et al. ..... D7/357
7,614,518 B2 * 11/2009 Barber ..... 220/23.89
2008/0148964 A1 * 6/2008 Shen et al. ..... 99/427

* cited by examiner

*Primary Examiner* — Harry Grosso
(74) *Attorney, Agent, or Firm* — Oblon, Spivak, McClelland, Maier & Neustadt, L.L.P.

(57) ABSTRACT

Embodiments of the invention include a main body portion for holding cake(s) and/or cupcake(s). The main body portion includes a plurality of recesses configured to retain a baked good therein. Various portions of the main body along with the cake(s) and/or cupcake(s), can be designed, colored, and decorated so as to collectively portray a desired theme for the cake and/or cupcake display.

19 Claims, 11 Drawing Sheets

HOLDER, DISPLAY, AND TRANSPORT APPARATUS FOR BAKED GOODS

CROSS REFERENCE

This application is a continuation of and is based upon and claims the benefit of priority under 35 U.S.C. §120 for U.S. Ser. No. 13/416,511, filed Mar. 9, 2012, the entire contents of which are incorporated herein by reference.

BACKGROUND

In the field of arranging of food products for service, such as at parties and the like, methods have been adopted for the display of individual baked goods, such as cakes and cupcakes. A well known type of cupcake holder is a flat metal pan or tray, usually rectangular in shape. Often, cupcakes are arrayed in a pattern on a tray or plate, or are placed in a fixed holder such as a collection of cups. The planar tray can have a pattern of cup-shaped recesses that typically are circular in cross-sectional shape and taper downwardly from an open upper end.

At a birthday celebration, friends and relatives of the birthday person will enjoy a birthday cake and/or cupcakes after finishing a meal and opening presents. Young children, in particular, enjoy the fun and excitement of birthday parties and thoroughly enjoy eating the birthday cake/cupcakes. After eating the cake/cupcakes, the children will discard their plates and return to playing other birthday games. The tray on which the cake/cupcakes were served must be cleaned and then is stored for subsequent use. As there might not be an easy and clean way to remove the cake from the tray, and as the tray might not have any further use, the tray holding the cake will sometimes be disposed along with any remaining cake.

Further, when having a birthday celebration, a cake and/or cupcakes are often purchased and candles and other party paraphernalia are placed on the cake/cupcakes. Such party paraphernalia may include small plastic novelties and signs, e.g., Happy Birthday, Happy Anniversary. Typically, the candles and other party paraphernalia are thrown away after the eating of the cake/cupcakes since they will not serve any further use and this will relieve the party planner from having to package and store such items.

SUMMARY OF ILLUSTRATED EMBODIMENTS

In selected embodiments, a cake/cupcake holder displays a variety of different bakery products such as cakes and cupcakes and is designed, colored and/or decorated in coordination with the design, coloration and decorations provided to the cake/cupcakes.

In an example, the cake/cupcake display can be formed and designed/decorated as part of a themed display and include graphical representations of the theme as well as other features and decorations representative of the themed display.

An example of the invention includes a cake and/or cupcake holder for transporting and displaying baked goods, such as a cake and cupcakes, while at the same time providing a utilitarian display apparatus and decorations that can be used as parts for a game/game board, for example, after the cake and cupcakes are removed and eaten.

In an example of the invention, a holder for the cake and cupcakes can be a structure for holding at least one cake along with a plurality of individually contained cupcakes located in an area around the cake.

In an embodiment, the cupcakes can be arranged around the cake at the same level as the cake. In a further example, the cupcakes can be arranged at various levels, for example higher or lower, with respect to the level of the cake. In this way, each cupcake is easily visible and accessible as well as readily removable by the persons at the party, especially the children.

An example includes a cake/cupcake support member provided below the main body of the cake/cupcake holder to provide support during display and/or transport. In a further embodiment, a cover can be provided which can be secured to the main body and/or support member for protection for the baked goods during transport and/or storage.

In an example, one or more locking devices can be included to securely connect the various elements of the cake/cupcake apparatus, such as the main cake/cupcake display, the support member, cover and any other features of the apparatus.

An example of the invention includes a display apparatus having a portion for supporting a cake as well as a plurality of portions for supporting cupcakes. In an example, one or more of the cake and/or cupcake holding portions includes indents or grooves to aid in the removal of the cake and/or cupcake from the display.

In a further embodiment, one or more of the recesses holding the cake and/or cupcakes, includes an aperture to ease the removal of the cake and/or cupcakes from its stored position.

In a preferred embodiment of the invention, a top surface of the cake/cupcake display apparatus is formed with and includes a plurality of shapes, sizes, colors, pictures, designs, etc. depicting any desirable object, such as a human, cartoon character, inanimate object, animal, etc. which will provide an entertaining themed display pleasing to the persons who will consume the cake/cupcakes, especially the children.

Another example of the present invention provides reusable cake and/or cupcake decorations/paraphernalia capable of being placed around, on or at least partially within the cake and/or cupcakes that are designed to allow the persons at the party to use the items as accessories to wear, to use as game pieces with the display apparatus, as party favors to take home, and/or for purely decorative purposes.

In an example of the invention, a top surface of the cake/cupcake display is formed at an angle with respect to the substantially planar bottom surface of the display.

A still further object of the present invention provides a novel multiple tiered cake and/or cupcake structure wherein the areas for holding the cake/cupcakes may be square shaped, heart shaped, diamond shaped, round and the like, as desired.

An embodiment of the invention includes a sound receiver/generator/transmitting portion provided with the main body of the display device, for example in an interior of the main body. A memory and processor/sound chip can also be provided with the main body arranged in the interior of the main body and be configured to generate an audio noise either prerecorded by the purchaser as a specific message to a partygoer or can be prerecorded by the manufacturer that relates to the theme of the baked goods display.

In one or more embodiments of the invention, the baked goods display can be designed as a decorative reusable display. In an example, the one or more support portions for the cake(s)/cupcake(s) can have reflective material, for example a mirror, provided therein.

In a further example, one or more of the support portions can have any desirable picture provided therein, for example a picture of one or more attendees at the party/special occasion. In a further example, the main body can be used as a picture frame.

In an example of the invention, the main body of the cake/cupcake display can include illuminating elements to enhance the themed display.

In a further embodiment, the cake/cupcake display can include a device that provides movement to one or more portions of the main body or to a collateral decorative element.

In an embodiment, the main body of the baked goods display can be formed to include a wall mount device so the main body could be hung on a wall after use.

In a further embodiment, the main body of the cake/cupcake display includes an attachment portion that will allow items to be attached to the main body, such as a backdrop and/or printed message, e.g. Happy Birthday.

It is an object of the invention to provide improved elements and arrangements thereof in an apparatus for the purposes described which is inexpensive, dependable and fully effective in accomplishing its intended purposes.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF ILLUSTRATIVE EMBODIMENTS

Figure 1:
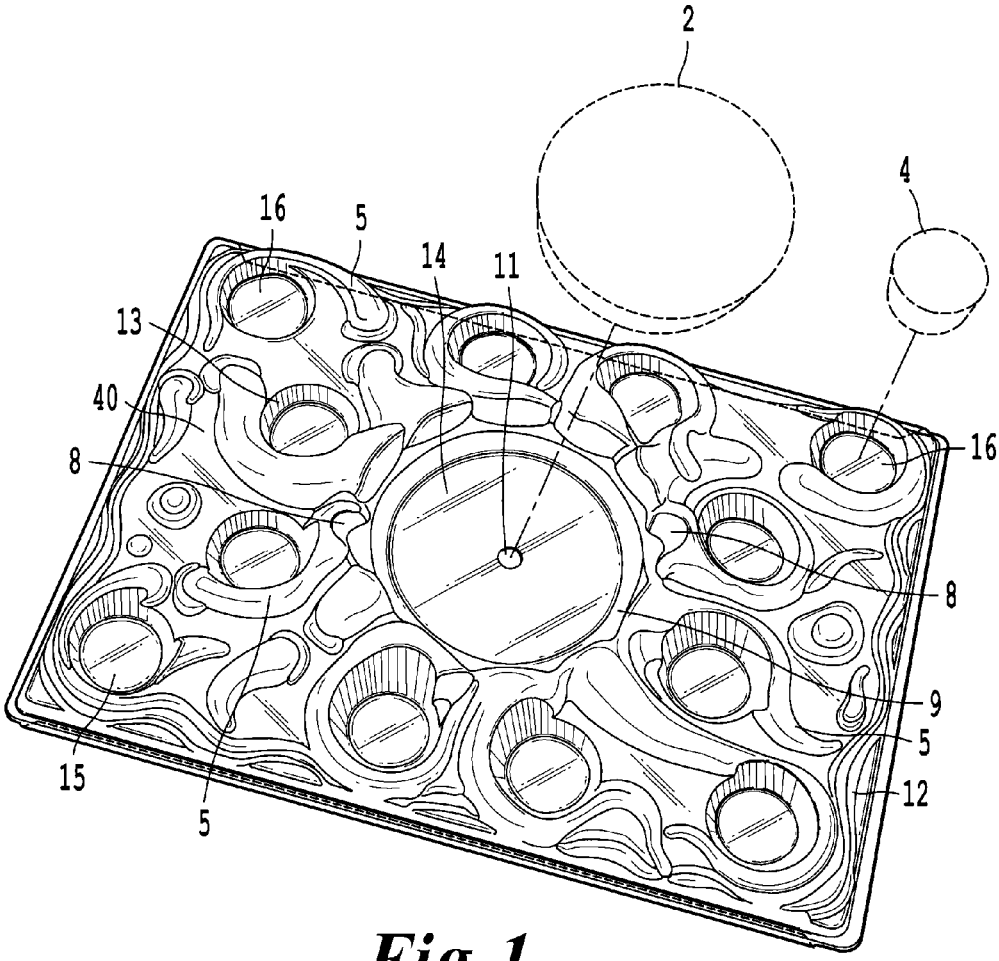
FIG. 1 is a perspective view of a cake/cupcake display apparatus according to an example of the invention.

Referring now to the drawings, wherein like reference numerals designate identical or corresponding parts throughout the several views.

Referring to FIGS. 1-4, the cake and/or cupcake holder of embodiments of the present invention is generally indicated by the reference numeral 10 and includes a main body portion 12 for holding one or more cakes 2 and/or one or more cupcakes 4. In an example of the invention, the main body portion 12 includes a generally central cake support portion 14 for receiving a cake, which can be surrounded by a plurality of cupcake support portions 16. The cupcakes 4 to be secured in the cupcake support portions 16 are preferably of the conventional type that has a paper shell surrounding the baked cake portion topped with one or more of icing, candy, rings, small toys, party favors, decorative icing or any other edible and/or non-edible items and the like.

In one or more further examples of the invention, the central cake support portion 14 and cupcake support portions 16 can be any desirable shape including, but not limited to, substantially circular, square, rectangular, octagonal, triangular, heart-shaped, diamond, etc, which can receive a cake/cupcake having a substantially similar shape. In further examples, the central cake support portion 14 and cupcake support portions 16 can be in a shape of a figure or character, for example, Mickey Mouse, SpongeBob, and the like.

Figure 2:
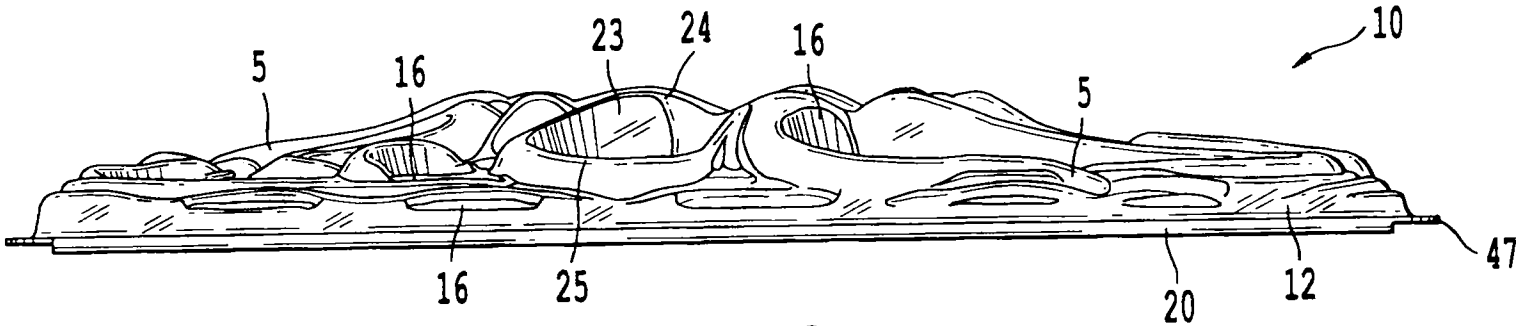
FIG. 2 is a side view of the cake/cupcake display apparatus according to a example of the invention shown in FIG. 1.

In an example, the cupcake support portions 16 can be positioned anywhere about the main body portion 12 as desired. In an example, the cupcake portions 16 are provided surrounding the cake support portion 14 at different heights with respect to a bottom surface of the main body 12 relative to the cake support portion 14, as shown in FIG. 2 for example. In this way, depending on the style/design/theme of the cake/cupcake display, the cupcakes 4 can be provided so as to at least not substantially overlap with each other as viewed by the children and purchaser of the cake/cupcake display.

The cupcake support portions 16 define circular openings 13 with arcurate inner side walls for receiving for example, a paper cup of a cupcake. The paper cups are generally frustoconical in shape, having a smaller diameter at the bottom and a larger diameter at the top, but can have any shape such as a substantially consistent diameter. In an example, the diameter of the opening 13 is large enough to accept the entirety of the paper cup/cupcake so that a bottom surface of the paper cups/cupcakes rests on a substantially planar bottom surface 15 of the cupcake support portions 16. In an example, one or more of the paper cup/cupcake can rest within the opening 13 of the support portion 16 but does not have to contact the side surfaces of the cupcake support portions 16.

In an embodiment, at least a portion of the outer circumference of one or more of the paper cup/cupcake will contact at least a portion of the inside side surface 23 of the opening 13 to support the cupcakes 4 within the cupcake support portions 16. In an example, the diameter of the opening 13 is sized so that the paper cup/cupcake can be supported along at least a portion of a side surface of the paper cup, for example at substantially a mid-point of the cupcake so that the cupcake 4 fits securely within the support portion 16, which can prevent jostling of the cupcakes during transport for example. However, as desired, the cupcakes 4 can be supported at any place around the outer circumference of the paper cup/cupcake due to aesthetic, design, and other considerations.

Figure 3:
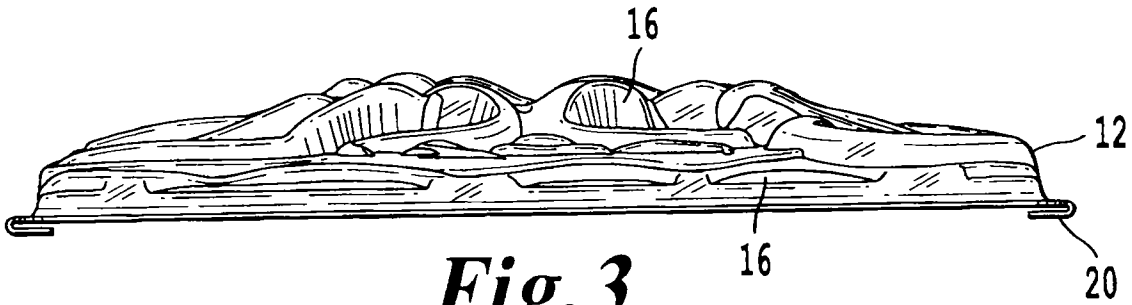
FIG. 3 is a side view of the cake/cupcake display apparatus according to a example of the invention shown in FIG. 1.
Figure 4:
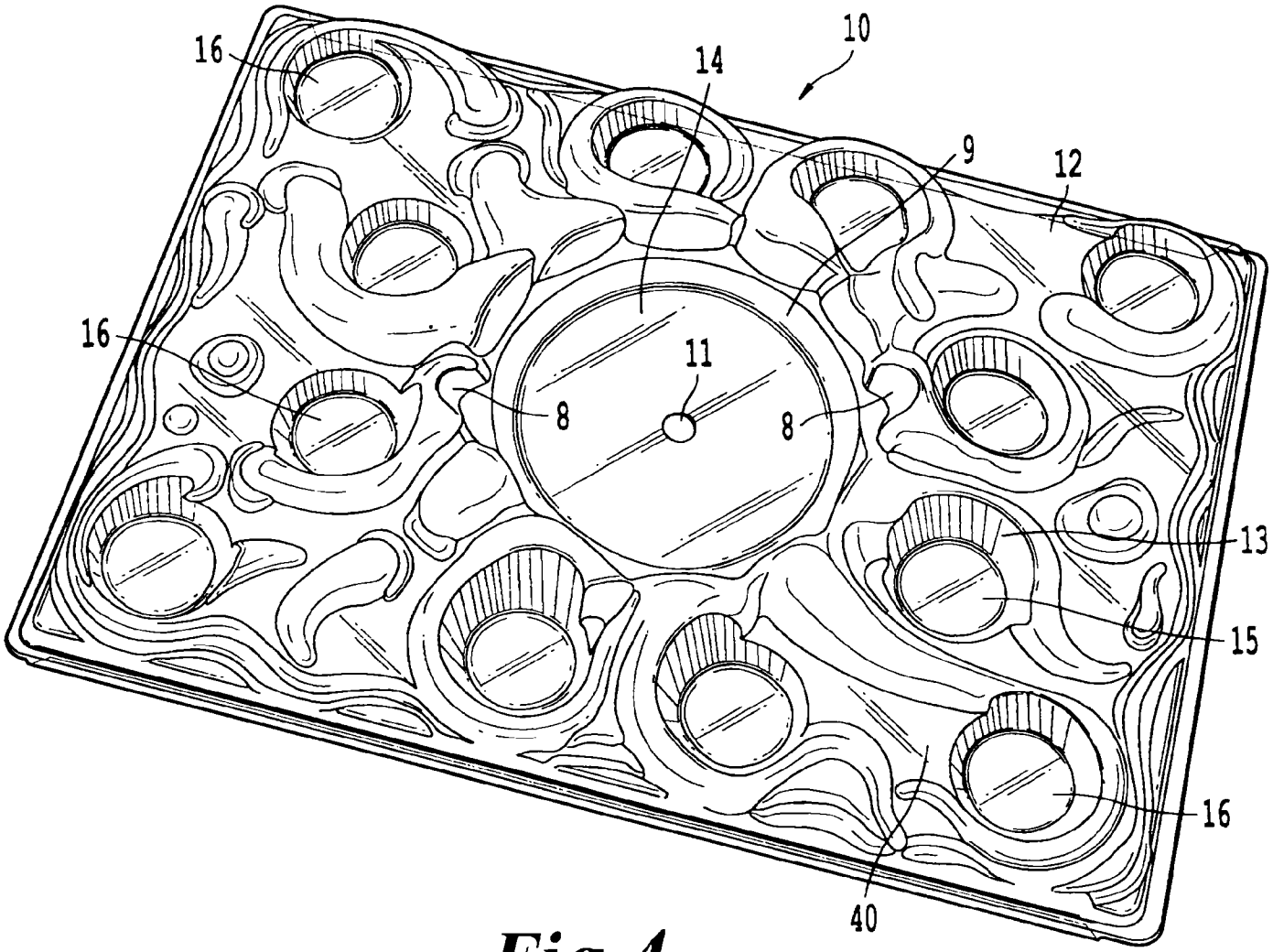
FIG. 4 is a perspective view of a cake/cupcake display apparatus according to an example of the invention.

In an embodiment of the invention, the cupcake support 16 can have inner side surfaces 23 that vary in height around a circumference of the opening 13. For example, as shown in FIGS. 2-3, the inner side surface 23 has a portion 24 that extends higher than a portion 25 with respect to the planar bottom surface 15 of the cupcake support portions 16. That is, a top surface of the cupcake support 16 can be non-planar. As such, due to design and aesthetic reasons, the amount of contact between the cupcake 4 and the side surface 23 can vary around the height and/or circumference of the cupcake. In this way, the cupcake 4 residing therein can be supported differently on different sides of the cupcake and varying amounts of the top and/or sides of the cupcakes can be viewed by the consumer. In this example, more of a particular side surface of the cupcake can be exposed which will allow for example the children at the party, to have a greater view of the cupcake 4 as well as easier access to the cupcakes 4 to grab when they are ready to eat. Further, it should be appreciated that each of the cupcake support portions 16 and side surfaces 23 can have different sizes, heights and shapes from one or more of the other cupcake support portions 16. Similar to the sizes and shapes of the cupcake support portions 16, one or more of the cake support portions 14 can be varied in a like manner.

In a preferred embodiment, the main body 12 is made of a flexible vacuum moldable plastic that is designed as a single unitary piece, in which the circular central cake support portion 14 and plurality of cupcake support portions 16 are disposed in a predetermined, fixed pattern around the cake support portion 14. In an embodiment, there are a large number of cupcake support portions 16 compared to the number of cake support portions 14. For example, a single cake support portion 14 may be provided while 4 to 36 cupcake portions 16 are provided. In a further embodiment, between 8 and 24 cupcake support portions 16 are provided. In an example, between 10 and 16 cupcake support portions 16 are provided. In a preferred embodiment 12 cupcake portions 16 surround a cake support portion 14.

In a further example, the main body 12 can be designed to support only one or more cakes 2 having the same or a variety of different sizes from each other. In a further example, the main body 12 can be designed to support only one or more cupcakes 4, which have the same or a variety of different sizes from each other.

It is within the spirit and scope of protection of the present invention to have any desirable number of cake and cupcake support portions having one or more sizes provided with the main body 12 of the holder 10. In an example, the main body 12 could have no cake support portions 14 but have one or more cupcake support portions 16. Alternatively, the main body 12 could have no cupcake support portions 16, but have one or more cake support portions 14 of the same or different sizes. As such, an important aspect of the invention is the formation of a cake/cupcake display apparatus that includes one or more cakes 2 and the one or more cupcakes 4 placed at any position, orientation, angle and/or height with respect to the main body 12 so as to provide cake/cupcakes as part of an overall design/theme of the display that is both aesthetically and visually pleasing and which can also enhance the enjoyment and utilitarian aspects of the display.

The design and materials of construction of the cake/cupcake holder 10 can be from numerous different materials and manufactured using a variety of different manufacturing techniques. Generally, a polymer with a traditional fabrication process using vacuum forming techniques, injection molding, etc. can be employed. The structure can be designed for a one-time use or allow for limited or virtually indefinite use, depending on the process selected and desired use. One possible manufacturing method would be to thermoform the cake/cupcake holder 10. A non-limiting list of plastics include PVC based materials, polystyrene, polypropylene, polyethylene, and the like. Non-plastic materials such as glass, paper laminates or metals, etc. can also be used. In an embodiment, the cake/cupcake holder 10 is molded, unitary construction, preferably made from plastic, and can be provided with a plurality of colors, designs, shapes, opacities, and sizes.

As discussed above with respect to one or more embodiments of the invention, the main body 12 can be molded to include multiple recesses to place cake(s) 2 and/or cupcakes 4 therein. In order to even further enhance the enjoyment of the themed display provided by the holder 10 and the cake/cupcakes thereon, the top surface 40 and/or side surfaces 17 of main body 12, can be molded to include one or more regions of non-planar shapes in and around the cake support portion 14 and/or cupcake support portions 16. The non planar shapes can be design features 5 that extend upwardly and/or downwardly from the top surface 40 and/or side surface 17 and are shaped in the form of any desirable object or item that relates to the theme of the cake/cupcake display. Accordingly, the design/location/decoration of the cake 2 and cupcakes 4 in conjunction with the non-planar shapes formed by the main body 12, exemplifies a theme of the decorated cake/cupcakes display.

Figure 1A:
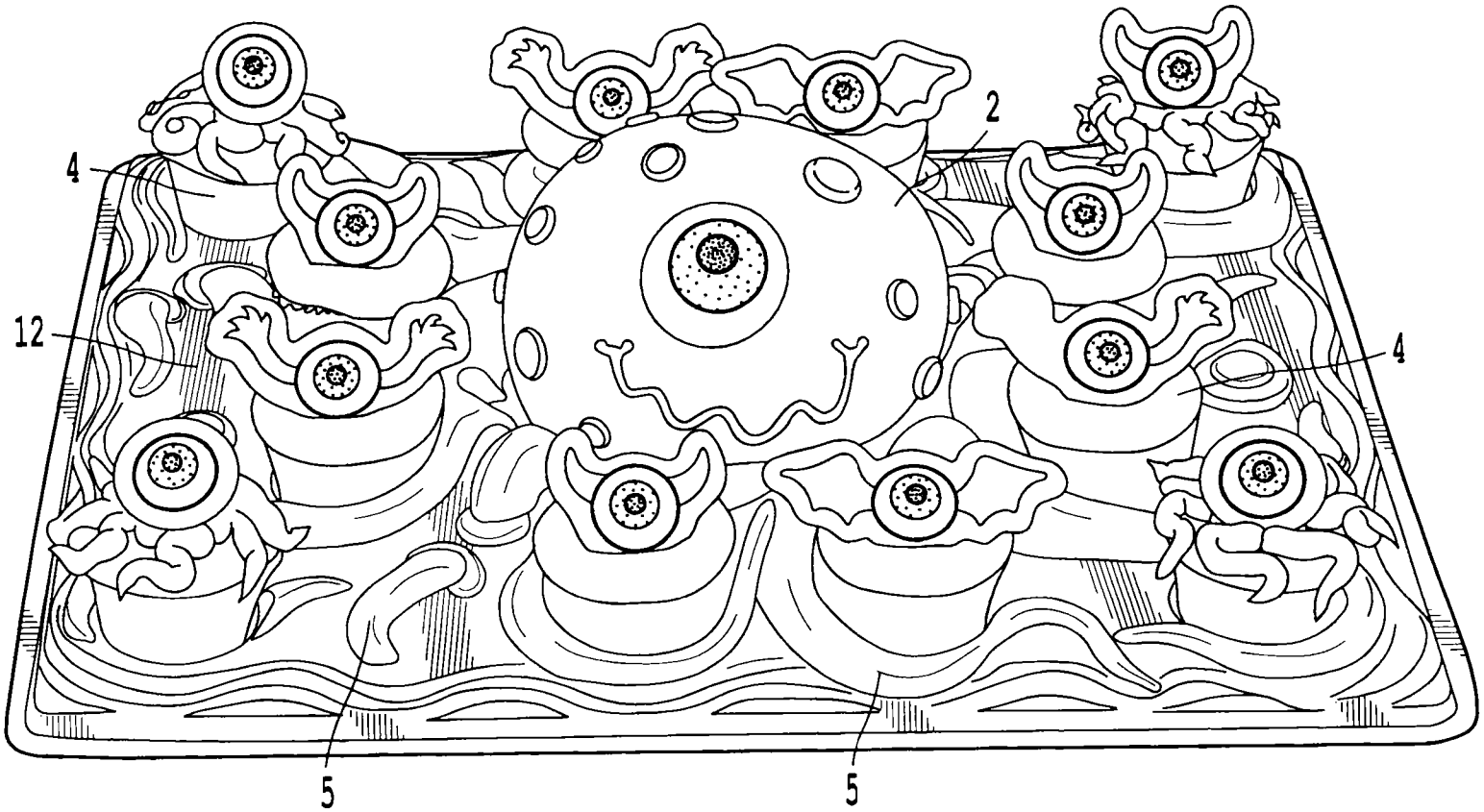
FIG. 1A is a perspective view of a cake/cupcake display apparatus according to an example of the invention.

In an example, the top surface 40 can be shaped to form at least part of an human, animal, cartoon character, a vehicle, inanimate object, a place in nature, etc. As such, it should be appreciated that the top surface 40 of the main body 12 can be molded into any desirable shape or form. As discussed, the top surface 40 can include design features 5 that extend upwardly or downwardly from the top surface 40 to form the shape of a desired object. For example, as shown in FIGS. 1 and 1A, the design features 5 can be multiple arms/limbs/tentacles for a monster. These design features 5 can be colored, painted, include stickers, or any other suitable means to make the design features look realistic.

In the example of FIG. 1, cake 2 can be any desirable shape and is provided in the cake support portion 14 so as to form a body and/or head for example of the monster/animal/creature. As discussed with respect to one or more embodiments of the invention, the cake 2 forming the "body" can be decorated with for example, icing, candy, or decorative items to make the cake 2 look like a desired body portion of the monster, for example the head. That is, in the example of FIG. 1A, the cake 2 forms the body of a sea creature and the design features are tentacles extending in and around the cupcake support portions 16 and the cupcakes 4 residing therein.

In a further example of the invention, any portion of the main body 12, for example the top surface 40, side surface 17, design features 5, cupcake support portion 16 and/or cake support portion 14, can include coloring, painting, pictures, stickers and the like. It should be appreciated that each of the various portions of the main body 12 can have the same or different color/design/style/shape to enhance the look and presentation of the main body 12 along with the cake and/or cupcake product. For example, the design features 5 discussed in embodiments below, can be formed as one or more colors that are different from a main color of the remainder of the main body 12. In this way, the design features 5 representing an object will be easily visible to the user as it contrasts with the background color of the main body 12.

Further, it should be appreciated that the top surface of the cake/cupcake can have any desirable substantially planar and/or non-planar shape. For example, the cake 2 and/or cupcakes 4 can be semicircular and therefore can extend out of the cake support portion 14 and/or cupcake support portion 16 so as to extend above a top surface 40 of the main body 12. In further examples of the invention, the cake 2 and/or cupcake 4 can be shaped as a pyramid, a box, a sphere, a diamond, etc. Therefore, the cake 2 and/or cupcakes 4 can reside only within the respective support portions or also extend out of the support portions depending on the desired theme of the cake/cupcake display.

In an example, in addition to icing and other edible decorations, the cake 2 can be decorated to include non-edible decorations placed thereon to further enhance the design of the cake as well as the overall theme of the integrated cake/cupcake display. In an example, the cake 2 can include decorations that imitate eye(s), nose, mouth, ears, hair, glasses, teeth, etc. to give a life-like look to the cake 2 when the cake is being decorated as a life-like object, for example human, animal, cartoon character, creature, etc. In an example of a cake 2 decorated as a monster shown in FIG. 1A, the cake 2 can include an eyeball(s) thereon and the design features 5 can be tentacles or arms formed near the edge of the cake support portion 14 so as to look like appendages of the creature and give a look of a complete creature. As shown in FIG. 1, the design features 5 can extend out from the top surface 40 and wrap in and around the cupcake holding portions 16, which gives the impression of an integrated design between the design/decoration of the cake 2 and the design/decoration of the one or more of the cupcakes 4. As such, the children will enjoy the themed presentation of the cake/cupcakes more than if the cupcakes were merely brought to them on a tray.

In one or more examples of the invention, the top surface 40 can be formed with a combination of design features 5 as well as also having at least a portion of the top surface colored, painted or include a picture so as to depict any desirable background scene or the like. In FIG. 1 for example, the design features 5 depicting the creature can be colored primarily a first color, while substantially the remaining top surface 40 can be formed from different colors and depict a background scene such as the jungle, forest, the sea, the sky/space, in a structure, in a vehicle, and the like. The background scene can also include other creatures the same or different from the main creature depicted by the design features 5, cake 2, cupcakes 4, and/or main body 12.

Figure 12:
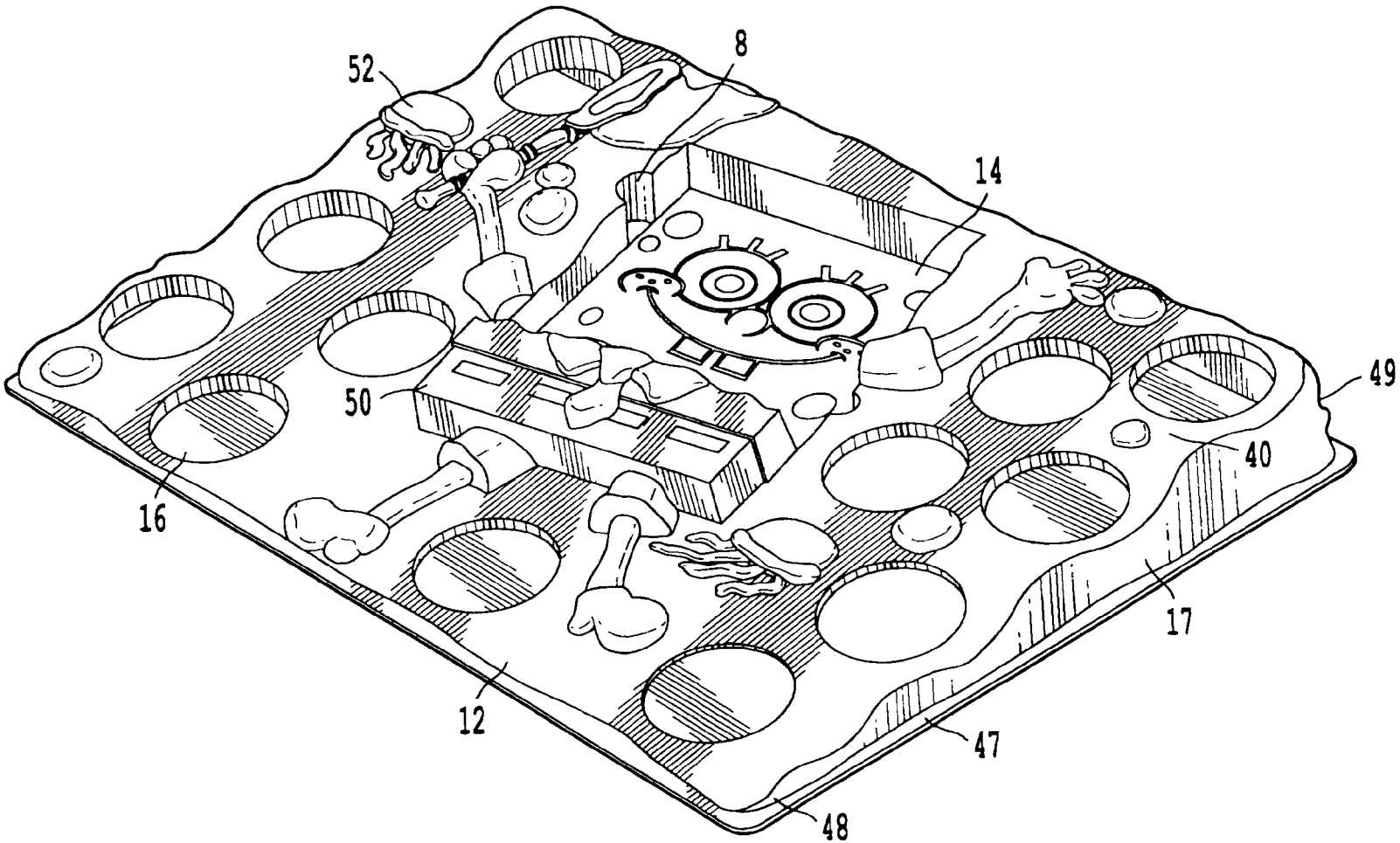
FIG. 12 is a perspective view of a cake/cupcake display apparatus according to a further example of the invention.

In a further example of the invention shown in FIG. 12, the image displayed on the main body 12 is of a cartoon character Spongebob Squarepants. As shown in FIG. 12, a design feature 50 forms a lower portion of Spongebobs body, including for example his pants, legs, shoes. As depicted, other features such as his arms, shirt, fishnet, etc. can also be formed as design features that extend above the top surface 40 of the main body 12. Other design features such as sea life 52 can be molded so as to extend above the top surface or can be painted on the top surface 40. Accordingly, in one or more examples of the invention, the cake support portion 14 and/or cupcake support portion 16 may be adorned by for example, paint, print, stickers, etc., so that after removal of the decorated cake(s) 2 and/or cupcake(s) 4, the main body 12 maintains a depiction of the scene and/or character.

In the example of FIG. 12, a cake 2 can be placed within the cake support portion 14 and cupcakes 4 can be placed in the cupcake support portions 16 to create the themed display of the cake/cupcake holder 10. As discussed in more detail with respect to this embodiment and other embodiments later, the cake 2 and/or cupcakes 4 can then also be decorated with non-edible decorative/utilitarian items such as party favors, game pieces, and the like, which enhance the enjoyments of the cake/cupcake display.

In an example of the invention shown in FIG. 1A, party favors, game pieces, and the like can be provided on top of one or more of the cupcakes 4. In this example, the cupcakes 4 can include items designed as eyeballs, which can match the look of the cake 2 forming the body of the creatures. The items provided with the one or more cupcakes 4 can be the same or different shape/style/color/size, etc. as the items provided on the other cupcakes 4. It should be appreciated that the items placed on the cupcakes 4 can depict any desirable person, place or thing.

Figure 13:
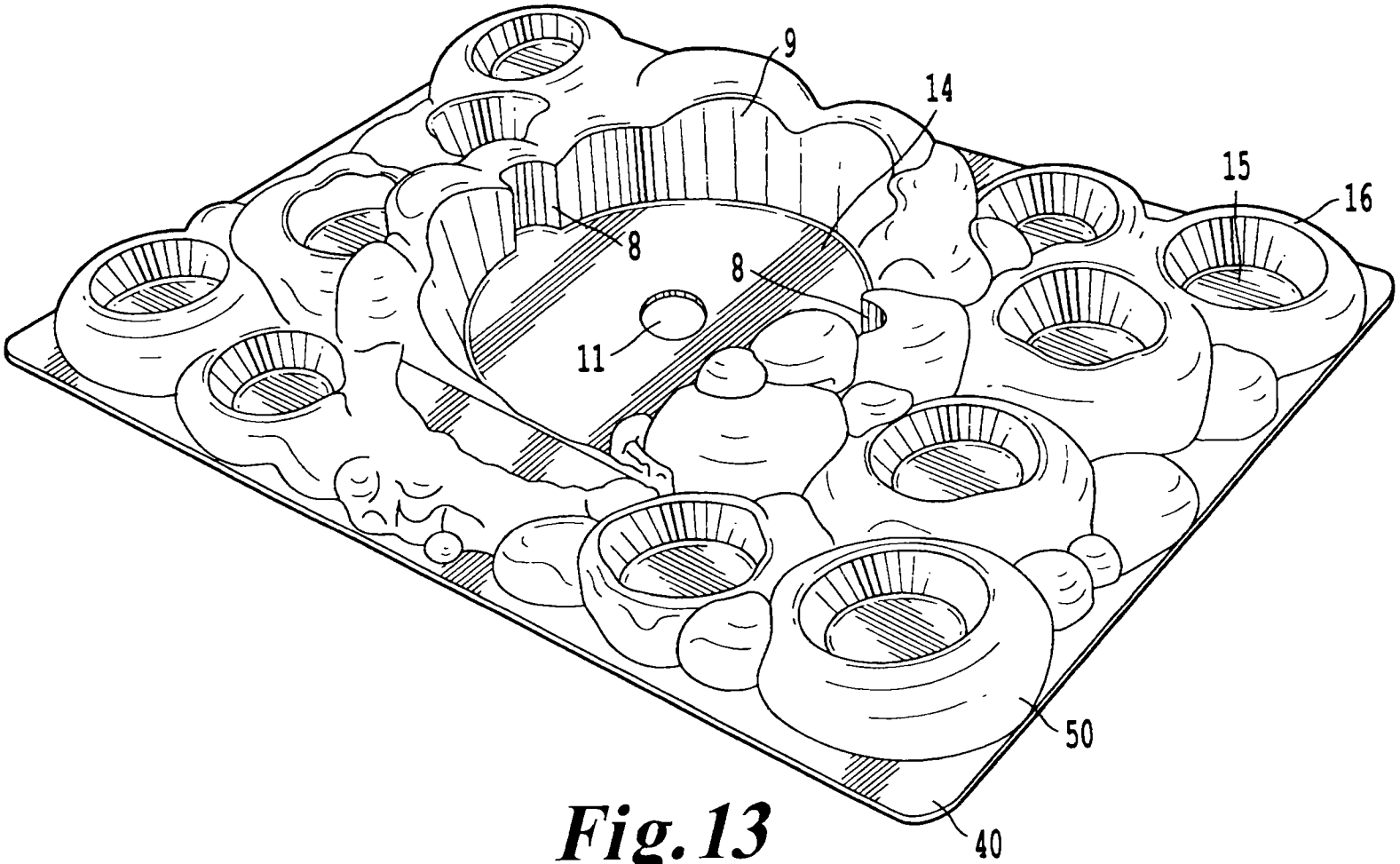
FIG. 13 is a perspective view of a cake/cupcake display apparatus according to a further example of the invention.

As shown in the example of FIG. 13, the design features 50 that are part of the decorations showing the desired theme, are projected above the top surface 40 of the main body. In this example, the design features 50 are depicting a cloud. Therefore, when the cupcakes 4 are placed in the cupcake holding portion 16, it will appear as if the cupcakes are resting in the clouds. As shown in FIG. 13, the clouds are formed at various heights above the top surface 40.

It should be appreciated that features of the claimed invention discussed above with respect to the various decorations, shapes, colors, design, etc. of the baked goods holder product, enhance the ability to market and sell cake and/or cupcakes for parties and other gatherings. In an example, the use of the main body 12 with design features 5 and colored or painted backgrounds can provide a means for selling cake/cupcakes in celebration of a holidays such as Christmas, Halloween, $4^{th}$ of July, Thanksgiving, and the like. In an example for Thanksgiving, the cake 2 and possibly the region around the cake support portion 14 can be decorated to look similar to a turkey. Meanwhile, the cupcakes 4 and possibly the region around the cupcake holding portion 16 can be decorated as other items to symbolize Thanksgiving like Pilgrims, Indians, apples, corn, etc. As an example for the $4^{th}$ of July, the cake 2 and possible the region of the main body 12 near the cake support portion 14 can be formed to symbolize a national landmark such as the Statue of Liberty or the Washington Monument, while the cupcakes 4 and/or surrounding region of the main body 12 around the cupcake support portions 16 can be decorated to look like exploding fireworks.

In one or more examples of the invention, the cupcakes 4 can be prepared and utilize different colors of icing. For example with respect to the $4^{th}$ of July embodiment discussed above, a quantity of cupcakes may be prepared with a white icing, a second quantity prepared with a red icing and a third quantity prepared with a blue icing. The cupcakes may be arrayed on the main body 12 in a necessary pattern to give an overall appearance of the American flag. In a further example of the invention, in addition to having one or more different decorations and/or icing provided for the cupcakes, the cupcakes can be made from a different flavor cake, such as chocolate, vanilla, strawberry, lemon, etc. In this way, at a child's party, there will be a myriad choices of flavors which should satisfy all the children in attendance.

Thus, in addition to using the cake/cupcake display for birthday parties, the cake/cupcake display could be used for many holidays, or other celebrated occasions, thereby supplementing traditional cake/cupcake sales by opening up a new market due to the design/decoration of the main body 12 along with the integrated design/decorations of the cake 2 and/or cupcakes 4 in view of the holiday, special occasion, or celebration. In this manner, different molds of the main body 12 could be produced, each mold for a particular occasion or holiday.

In one or more embodiments of the invention, one or more of the cupcakes 4 can also include a decoration thereon different from the icing or other edible decorations already provided on the cupcake. In an example, party favors, decorations, toys, game pieces, plastic rings, and the like can be placed on one or more cupcakes 4 to further enhance the overall theme/design and ultimate display of the cake/cupcakes.

In an example with respect to FIG. 1, one or more of the cupcakes 4 can include a colorful plastic eyeball or other body part placed thereon that coincides with the overall design of the creature/monster provided as the cake 2. In addition to items placed on the cupcakes 4, items can be placed on the cake 2 to also enhance the theme of the cake/cupcake display. For example, if the cake 2 includes a large eyeball depicting a monster, the cupcakes 4 can have smaller eyeballs relative in size to the cupcake size to give the impression of many smaller monsters surrounding the main monster formed by the cake 2.

After the children take their cupcake 4 to eat, they can play with the eyeball piece provided on the cupcake 4 and then take the item back home with them when they leave. Additionally, in an example, the item on top of the cupcake 4 can be used as part of a game that is associated with the main body 12. That is, the main body 12, after the cake/cupcakes have been removed and eaten, can be designed as a game board for play by the children. The item on top of the cupcakes 4 can be used as the game piece for the child to use when playing the game. In this way, the main body 12 can be used for more than carrying the cake/cupcakes to/from the party. Further, the main body 12 could then be used for multiple occasions, which will eliminate the waste of throwing away the holder 10.

In an example of the invention discussed with respect to FIG. 12 and Spongebob Squarepants, rings (not shown) can be placed on one or more of the cake 2 and/or cupcakes 4 for the children to remove and wear at the party. As an example, the rings can have stickers on them with pictures of Spongebob and other characters from the Spongebob Squarepants show.

In the example of FIG. 12, since it might be difficult to make the cake 2 placed in the cake support portion 14 look like Spongebob other than the color of the cake, a plac for the cake can be included with the holder 10 as part of a kit for example, that resembles facial features of Spongebob that can be placed on the cake. In this example with the Spongebob theme, the cake 2 and plac will look like Spongebob and the design feature 50, top surface 40, side surface 17, and/or the cupcakes 4 will be decorated to look like characters/scenes from the show, which will give an integrated themed display utilizing all aspects of the holder 10 and cake/cupcakes while at the same time, be very entertaining to the adults and children at the party.

In further examples of the invention, it should be appreciated that any desirable item can be placed on and around the cake/cupcakes to enhance the integrated theme of the cake/cupcake display. Further, the main body 12 can be repurposed after the party as a holder/caddy for the items provided with the display. For example, if the party is a girls birthday party, the cake 2 could have a princess crown placed on top for the birthday girl to wear. The cupcakes 4 could have items placed on top consistent with the princess theme, for example, flower rings, mini crown rings, jewelry, etc. After the party, the crown, rings, jewelry, and/or other items whether obtained at the party or by other means, can be secured to/within the main body 12, for example, to prevent from being lost, for transport, storage, and the like.

In a further example for a Dora the Explorer themed display, the cake 2 could resemble Dora, while the cupcakes 4 could have rings that have stickers of Dora's friend on them. Further, as discussed above with respect to other embodiments of the invention, the main body 12 can also be decorated based on the theme of the display. Therefore, with a Dora theme, the main body 12 could have a background of a jungle with mountains, trees, beaches, etc. to give the impression of Dora on an adventure.

It should be appreciated that the decorations that can be placed on the cake/cupcakes as well as any other aspect of embodiments of the invention, can be provided as part of a kit for preparing and decorating the cake/cupcake display. In an example, the themed decorations can be removably attached to a portion of the main body 12, for example on the top surface 40 and/or side surface 17. In a further example, the decorations can be provided/stored in a bottom portion of the main body 12 prior to use and/or for subsequent use.

In this fashion discussed with respect to one or more embodiments of the invention, the baked goods such as the cake 2 and/or cupcakes 4, which are placed for display on the main body 12 may be interspersed with premanufactured designed/decorative items to add to the entertainment and aesthetics of the overall completed themed display.

Figure 8:
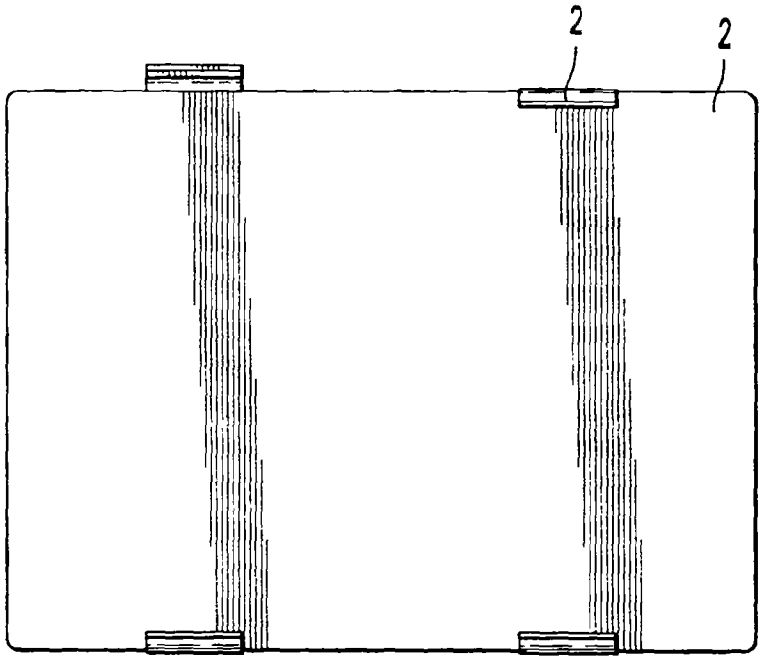
FIG. 8 is a bottom view of a cake/cupcake display apparatus according to an example of the invention.
Figure 10:
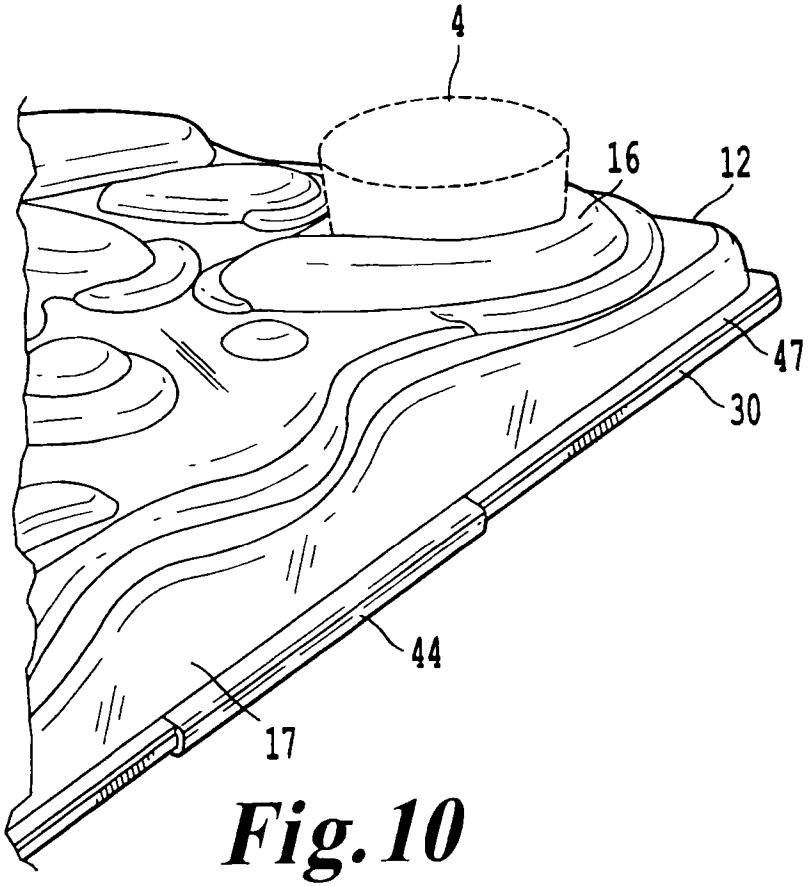
FIG. 10 is a side perspective view of a cake/cupcake display apparatus according to an example of the invention.

In further examples of the invention, a height of the side surface 17 can vary along the length of the side surface 17. As shown in FIG. 12, a height of the side surface 17 located towards a front end 48 of the main body 12 is lower than a height of the side surface 17 toward the back end 49. FIG. 8 shows a generally constant gradual increase in height from the front 48 to the back 49 for the top surface 40, however, it should be appreciated that the height can vary along the length of the side surface 17 in any manner desirable for design and/or aesthetic reasons. In this way, a viewing angle for the children is increased for the top surface 40 and thus the cake 2, cupcakes 4, design features 5, decorations, etc. provided thereon, which will increase the enjoyment of the display for the children.

Further, in one or more embodiments, the bottom supporting surface of the cake and/or cupcake support portions can be formed at an angle with respect to a substantially planar bottom surface formed by the main body 12. Thus, in addition to altering the display angle with the side surface 17 discussed above, the display angle for the cupcakes 4 formed by the cupcake support portions 16 can alter the viewing/display angle of the cupcake 4. For example, if the themed cake/cupcake display is a volcano, one or more of the cupcakes 4 can be angled outwardly from a cake 2 that forms a main body of the volcano. In this example, the higher the cupcake 4 is positioned on the volcano, the greater the angle can be provided for displaying the cupcake 4. Accordingly, one or more of the cupcakes 4 placed in the cupcake support portions 16 and held therein, can be displayed at different heights from the other cupcakes 4 and/or cake 2, and can be supported at different positions around the circumference than other cupcakes, based on necessary support and/or a desired positioning of the cake/cupcakes for the presentation of the themed display.

In one or more examples of the invention shown in FIGS. 5-10, a supporting engagement is shown between the main body portion 12 of the cake/cupcake holder 10 and a support member 30. The support member 30 can be included below the main body 12 in an example of the invention, to structurally support the main body 12 during movement of the main body. Securing the main body 12 and support member 30 together will prevent them from moving with respect to one another, which would jeopardize the stability and security of the cake and/or cupcakes residing on the main body 12. In one or more embodiments of the invention, the support member 30, for example corrugated fiberboard, is a backing member that supports the main body portion 12 during for example, transport, display and/or storage of the main body portion 12, which helps maintain the structural integrity of the main body 12 when the cake and/or cupcakes are placed on the main body 12.

In one or more examples of the invention, the main body portion 12 can include a curved bottom edge portion 20 that can extend out from a bottom edge of the main body 12, for example, extending from the flange portion 47, to a position ending below the main body 12. The curved bottom edge portion 20 can be provided with one or more side surfaces of the main body 12. In this way, the support 30 can slide under the main body 12 and within the area formed by the curved bottom edge portion 20, as shown in FIG. 5 for example, to secure the support member 30 therein and thereby provided support for the main body portion 12.

Figure 5:
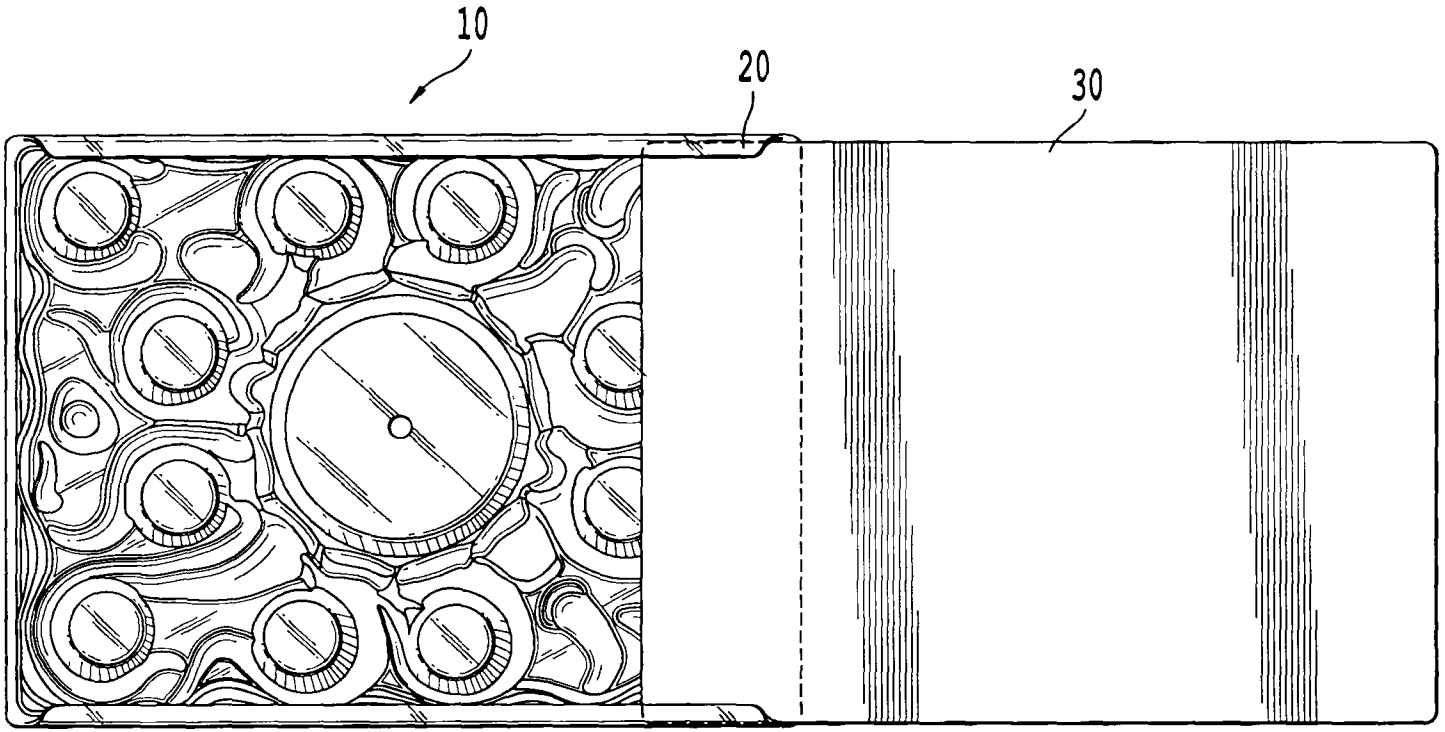
FIG. 5 is a bottom view of a cake/cupcake display apparatus and support member according to an example of the invention.
Figure 6:
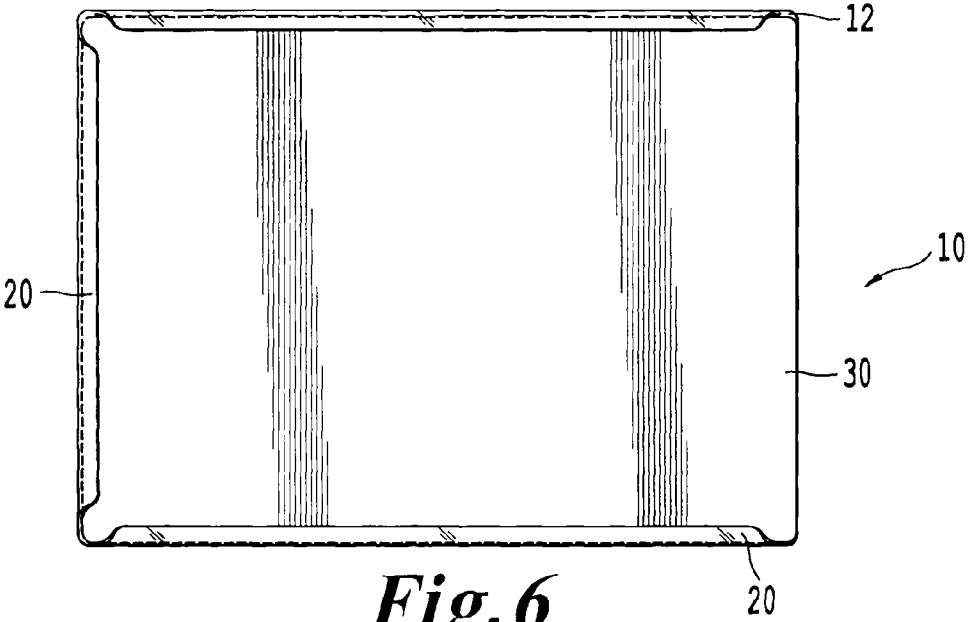
FIG. 6 is a bottom view of a cake/cupcake display apparatus and support member according to an example of the invention.
Figure 7:
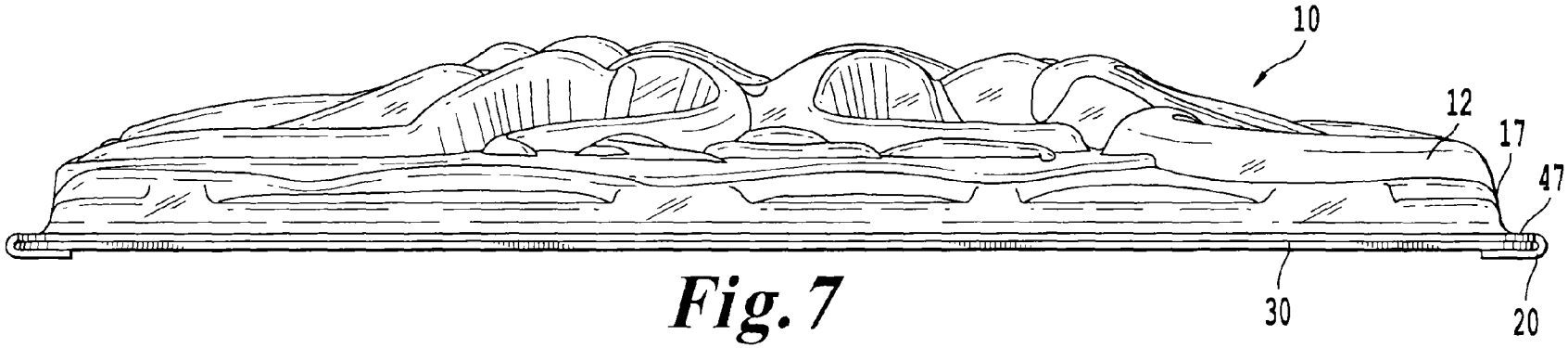
FIG. 7 is a side view of the cake/cupcake display apparatus and support member in an example of the invention shown in FIG. 6.
Figure 9:
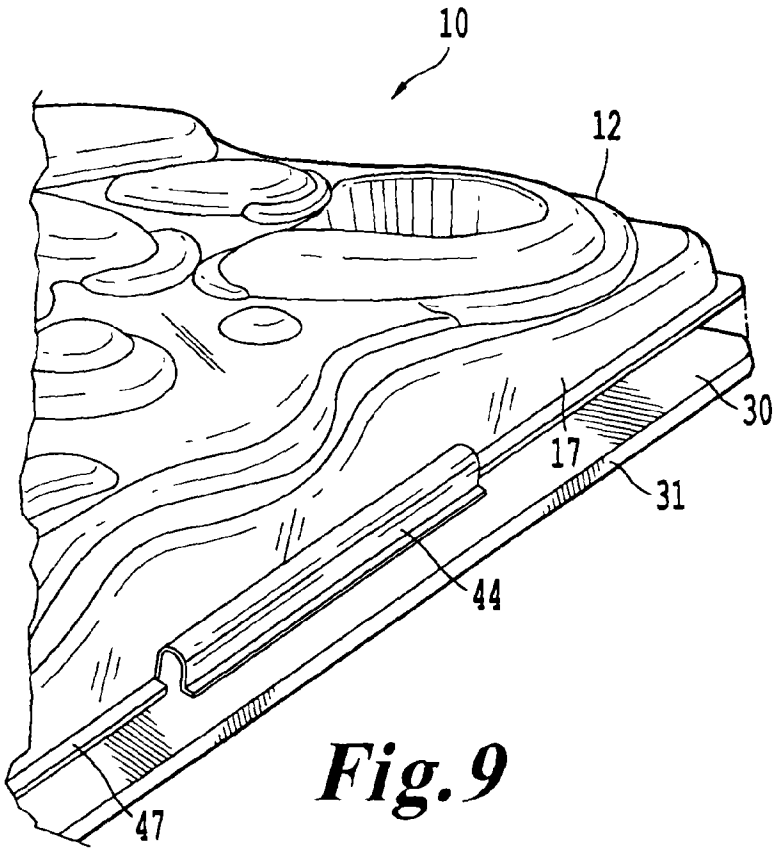
FIG. 9 is a side perspective view of a cake/cupcake display apparatus according to an example of the invention.

In an example of the invention, the curved bottom edge portion 20 can be provided along two sides of the main body 12 on opposite sides of the main body 12 as shown in FIG. 5. In a further example of the invention, the curved bottom edge portion 20 can be provided along three sides of the main body as shown in FIG. 6, which can prevent the support member 30 from sliding too far underneath the main body 12 and ensure the support member 30 is properly positioned to support the main body 12. It should be appreciated that the curved bottom edge portions 20 can extend any length along the side surface of the main body 12 and any length across the bottom surface of the main body 12 including extending all the way across the bottom surface.

In one or more embodiments of the invention, the main body 12 and support member 30 can be secured together with one or more locking devices 44 provided on one or more of the sides edges of the main body 12 and/or provided on one or more sides of the support member 30. For example, a lower portion of a side surface 17 of the main body 12 can include one or more locking devices 44 pivotally attached thereto, which can rotate between an open and closed position. When in the closed position, the one or more locking devices 44 provided with the main body 12 can securely clasp at least around the edge 31 of the support member 30 and preferably also along a bottom surface of the support member 30. Accordingly, it should be appreciated that the one or more locking devices 44 can be an element of and integral to either the main body 12 and/or the support member 30, or may be a separate device that engages with both the main body 12 and support member 30 to securely couple them together.

The one or more locking devices 44 can secure the main body 12 to the support member 30 alone or in combination with curved bottom end portion 20. For example, if the curved bottom edge portion 20 discussed above is provided on three sides of the main body 12, one or more locking devices 44 can be provided on the remaining side to lock the main body 12 and support member 30 together.

Figure 11:
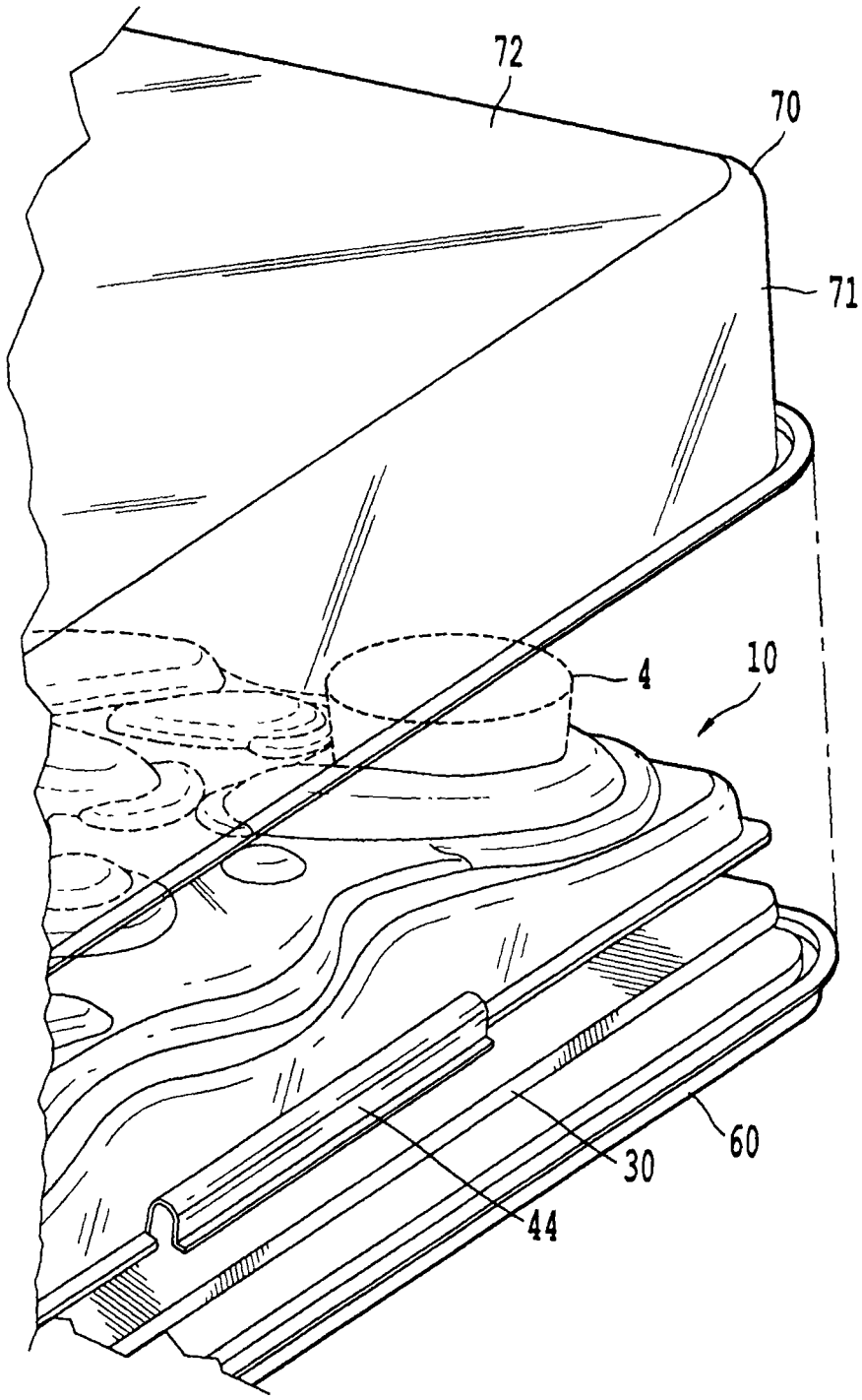
FIG. 11 is a perspective view of a cake/cupcake display apparatus according to a further example of the invention.

In one embodiment of the invention, the main body 12 with the support member 30 for example, may fit within existing tray and cover configurations currently in common use to transport and display baked goods. As shown in FIG. 11 in an example of the invention, a detachable cover 70 or dome, made of plastic for example, may be provided to enclose the cake/cupcake holder 10 and the contents thereon. The cover 70 includes a top 72 and an angular side walls 71 extending down from the top and defining a chamber in which the main body 12 of the cake/cupcake holder 10 may be disposed. As shown in FIG. 11 for an example of the invention, the cover 70 can be conventionally secured to a planar and rigid lower support tray 60 by way of a uniformly designed depressed region running the circumference of the support tray 60, which will securely hold the main body 12 therein. After the cover 70 is secured to the support tray 60, the main body 12 and support member 30 are sealingly maintained within the cover 70 to prevent any movement of one with respect to the other.

In an example of the invention, the cake support portion 14 can include an aperture 11 provided substantially in a middle portion of a bottom surface of the support portion 14. The aperture allows for a user to insert a finger there through in order to help push the cake 2 out from the recess formed by the cake support portion 14. In an example, the cake 2 can rest upon a cake board (not shown) which lies within the recess of the cake support portion 14. When a user pokes their finger through the aperture 11, the cake board and therefore cake residing thereon, will be pushed at least partially out of the recess so the user can get an easier grip on the cake as needed. In an example, one or more cupcake support portions 16 can include an aperture and/or cupcake board similar to the aperture 11 and cake board in the cake support portion 14.

Alternatively, or in addition to the aperture 11, one or more examples of the invention can include one or more cut out portions 8 provided at or near the side edges 9 of the cake support portion 14. The cut out portions 8 will allow the user to slide their fingers in the cut out portion 8 along the side surfaces of the cake 2 to place the cake into or take the cake out of the cake support portion 14. The cut out portions 8 can extend any distance along the side edges 9 of the cake support portion 14. In an example of the invention, the cut out portions 8 extend all the way to the base of the cake support portion 14 that supports a bottom surface of the cake 2. If a cake board discussed above is used to support the bottom surface of the cake 2, then a user can reach their fingers down to a position of the cake board and pick the cake 2 up using the cake board without unnecessarily contacting the cake with their hands and potentially disrupting the design of the cake and/or decorations placed on the cake 2.

In a further example, one or more of the central cake support portion 14 and plurality of cupcake support portions 16, can include one or more securing devices formed along the bottom surface 15 in order to help secure the cupcake within the cupcake support portions 16. For example, the bottom surface 15 can include one or more protrusions, for example pointed ridges, along the bottom surface. In a further example, the bottom surface 15 can include spike like elements that project out from the bottom surface 15 to engage a bottom surface of the cake, cupcake and/or cupcake wrapper.

An embodiment of the invention includes a sound receiver/generator/transmitting portion provided with the main body 12 of the display device, for example in an interior of the main body 12. A memory and processor/sound chip can also be provided with the main body 12 arranged in the interior of the main body and be configured to generate an audio noise. The audio noise can for example, be prerecorded by the purchaser as a specific message to a partygoer that can be played by the pressing of a button or the like to cause the processor/sound chip to play the message when pressed. Alternatively, one or more messages can be prerecorded by the manufacturer that relates to the theme of the baked goods display and a device could be provided to enable selection of a particular message to be played for the guest(s) of honor when desired. As an example with respect to FIG. 12, a prerecording of Spongebob and/or other characters from the show singing Happy Birthday can be stored in the memory and played for the birthday child and his friends.

In one or more embodiments of the invention, the baked goods display can be designed as a decorative reusable display. In an example, the one or more support portions for the cake(s)/cupcake(s) can have reflective material, for example a mirror, provided therein.

In a further example, one or more of the support portions can have any desirable picture provided therein, for example a picture of one or more attendees at the party/special occasion. In a further example, the main body can be used as a picture frame.

In an embodiment, the main body of the baked goods display can be formed to include a wall mount device so the main body could be hung on a wall after use. For example, the main body 12 could have one or more apertures to allow the main body 12 to be hung on a nail or the like secured into a wall. Alternatively, support flanges could be provided on a backside of the main body engageable with a projection sticking out of the wall, which will support the main body when it is hung on the wall.

In an example of the invention, the main body of the cake/cupcake display can also include illuminating elements to enhance the themed display. For example, lights of any color can be integral with and secured to the top, bottom, and/or side surface of the main body 12 as well as any structure attached to the main body 12. The lights can illuminate any portion of the main body, for example in and/or around the cake support portion 14 and/or cupcake support portion 16. In an example shown in FIG. 12, lights can illuminate any part of Spongebob and/or the sea creatures 52 to enhance certain aspects of the themed design. In an example for Dora the explorer, lights could outline a path through the forest/jungle/sea/mountains, etc. The lights can be powered by any desirable replaceable or non-replaceable means. In an example, batteries can power the lights. In a further example, non-replaceable/non-rechargeable button cells permanently enclosed in the holder and not accessible to the consumer can be used.

In a further example, the main body 12 can be formed so that the opacity of the main body 12 is different in different portions of the main body 12. In an example, the main body 12 could include a gradual change of opacity along one or more directions of the main body 12. In an example, the main body 12 could include a varyingly opaque/clear main body, which reveals patterns, images, designs, pictures, lights, and the like, beneath. In an example, the patterns, images, designs, pictures, lights and the like are provided on the support member 30 provided under the main body 12.

In a further embodiment, the cake/cupcake display can include a device that provides movement to one or more portions of the main body. For example, movement could be provided to one or more parts of the main design element of the display. In an example for spongebob, one or more of Spongebob's arms or legs could move/shake/rattle/turn/spin and the like. Similarly, motion could be provided to one or more of the sea creatures 52 or other elements of the design. For the creature display shown in FIG. 1A, movement could be imparted to one or more of the tentacles. In an example, the movement could be provided by a conventional battery powered motion device.

In a further embodiment, the main body of the cake/cupcake display includes an attachment portion that will allow items to be attached to the main body so as to extend around the side surfaces of the main body 12. In an example, the attachment portion could be one or more slots formed along one or more of the side surfaces of the main body 12, which would allow the mounting of one or more decorations/displays/panels/pictures/lights/moving parts, and the like, into the slots. In an example, a picture/drawing etc. of a background scene could be attached to one or more sides of the main body to thereby visually expand the themed display on a much larger scale than provided by just the main body 12.

In an example for Spongebob, a tablecloth could be provided with the cake/cupcake display kit that depicts an undersea world. The tablecloth could be secured to the attachment portion on one or more sides of the main body 12, to not only depict the desired background but to also provide an easy way for the parents to keep a clean area where the kids are eating.

It can be seen, therefore, that the cake/cupcake holder of one or more embodiments of the present invention not only provides an improved holding means for cakes/cupcakes but also provides a convenient and entertaining means for storing and presenting the cake/cupcakes to the persons in attendance at the celebration for example, a child's birthday party.

Obviously, numerous modifications and variations of the present invention are possible in light of the above teachings. It is therefore to be understood that within the scope of the appended claims, the invention may be practiced otherwise than as specifically described herein.

The invention claimed is:

1. A system comprising:

a plastic base that includes a plurality of spaced apart recesses formed in a top surface of the base, each of the recesses being configured to retain a baked good therein, wherein each of the recesses has a substantially planar bottom surface;

a substantially planar and rigid support tray, wherein the base is sized to fit within the substantially planar and rigid support tray; and a flange that extends outward from a bottom surface of the base and that contacts the substantially planar and rigid support tray, wherein the base includes, as part of the top surface, a laterally extending area substantially entirely bearing one or more ornamental depictions, the laterally extending area extends around the recesses, the recesses are disposed in a non-rectangular themed pattern as part of the one or more ornamental depictions, the substantially planar and rigid support tray is configured to mate with an outer rigid lid, and the one or more ornamental depictions are part of an unitary plastic construction of the base.

2. The system according to claim 1, wherein the substantially planar and rigid support tray is a substantially continuously planar and rigid support tray.

3. The system of claim 1, wherein the base is sized to substantially match the substantially planar and rigid support tray.

4. The system of claim 1, wherein the base fits securely into the substantially planar and rigid support tray.

5. The system of claim 1, further comprising:

a support member, wherein the base has a bottom that is configured to receive the support member.

6. The system of claim 1, wherein there are at least 10 recesses.

7. The system of claim 1, wherein the recesses are separated by the laterally extending area.

8. The system of claim 1, wherein the recesses are configured to receive a cupcake.

9. The system of claim 1, wherein a bottom area of each of the recesses is smaller than an overall area of the base.

10. The system of claim 1, wherein a bottom area of each of the recesses is substantially equal to a bottom area of a cupcake.

11. The system of claim 1, wherein a texture of a bottom area of each of the recesses is different from a texture of the laterally extending area.

12. The system of claim 1, wherein an overall outline of the base includes a geometric shape.

13. The system of claim 1, wherein the flange is integrally formed with the base.

14. The system of claim 1, wherein the base is substantially different from the support tray.

15. The system according to claim 1, wherein the one or more ornamental depictions is an integrated design of a pattern of the recesses and the laterally extending area.

16. The system according to claim 1, wherein at least the laterally extending area includes a combination of different colors as part of the one or more ornamental depictions.

17. The system according to claim 1, wherein the one or more ornamental depictions includes a Christmas theme.

18. The system according to claim 1, wherein the one or more ornamental depictions is a background scene.

19. The system according to claim 18, wherein the background scene depicts an inanimate object.

* * * * *